US006644506B2

(12) United States Patent
Erlandsen

(10) Patent No.: US 6,644,506 B2
(45) Date of Patent: Nov. 11, 2003

(54) PROMOTING THE PURCHASE OF, AND VISUALLY VERIFYING THE AUTHENTICITY OF A MIXED PURCHASED BEVERAGE

(75) Inventor: David H. Erlandsen, Sierra Madre, CA (US)

(73) Assignee: Dr er'Ls Technology LLC, Sierra Madre, CA (US)

( * ) Notice: Subject to any disclaimer, the term of this patent is extended or adjusted under 35 U.S.C. 154(b) by 0 days.

(21) Appl. No.: 10/087,903

(22) Filed: Mar. 1, 2002

(65) Prior Publication Data

US 2003/0164384 A1 Sep. 4, 2003

(51) Int. Cl.[7] ..... B67D 5/56

(52) U.S. Cl. ..... 222/23; 222/113; 222/129.3; 222/146.6

(58) Field of Search ..... 222/23, 113, 129.1, 222/129.3, 129.4, 146.6

(56) References Cited

U.S. PATENT DOCUMENTS

| | | | | | |
|---|---|---|---|---|---|
| 2,034,420 | A | * | 3/1936 | Reiland et al. | 222/113 |
| 2,562,212 | A | * | 7/1951 | Rogers et al. | 222/113 |
| 2,631,393 | A | * | 3/1953 | Hetherington | 222/113 |
| 3,156,381 | A | * | 11/1964 | Plentis | 222/113 |
| 3,995,770 | A | * | 12/1976 | Schwitters | 222/146.6 |
| 5,586,691 | A | * | 12/1996 | Gotch et al. | 222/113 |
| 5,697,526 | A | * | 12/1997 | Lee | 222/113 |
| 6,059,145 | A | * | 5/2000 | Stratton et al. | 222/129.1 |
| 6,349,852 | B1 | * | 2/2002 | Ford | 222/129.1 |

* cited by examiner

*Primary Examiner*—Kenneth Bomberg
(74) *Attorney, Agent, or Firm*—Donald D. Mon

(57) ABSTRACT

A system for dispensing slushy or frozen beverages having an ingredient of interest or importance to a customer. A container of this ingredient is visible to the prospective customer, and an indicator establishes that this ingredient is being supplied while the total beverage is being withdrawn from a mixer.

15 Claims, 2 Drawing Sheets

PROMOTING THE PURCHASE OF, AND VISUALLY VERIFYING THE AUTHENTICITY OF A MIXED PURCHASED BEVERAGE

FIELD OF THE INVENTION

A beverage dispensing system visibly offering rapid production of complex drinks in the presence of intended purchasers and visibly verifying the source of important ingredients of the beverage.

BACKGROUND OF THE INVENTION

When one purchases a drink based on a simple ingredient such as a soda, there is no problem. These drinks are inexpensive, and their differences are readily recognized by their consumers. They recognize whether the drink is a cola or a ginger ale, and there is no appreciable cost differential between various ones of the brands. In fact, they generally are constituted in a proportioning nozzle at the base in which water (carbonated or not) in consumed with a syrup.

This constituted ingredient is often the subject of an order for a non-alcoholic drink. In busy bars and elsewhere, there is almost no interest in the details of what this "mixer" is. For well drinks the bartender simply adds the alcoholic liquor to it, and that is the end of it.

Depending on the class of the bar or restaurant, and of the cost of the alcoholic drink, alcoholic liquors of distinction or of higher cost are generally dispensed directly from its own bottle, and depending on its cost also in full view of the customer who sees the label on the bottle while the liquor is poured. For the price of such liquors, such a time-consuming gesture is expected.

However, there are premium liquors that are less expensive than ultra-rated liquors but better than "well" brands, that command much larger prices in mixed drinks. Customers often prefer these mid-range liquors. However, large installations cannot afford the labor costs and overhead of such individual presentations as are requested for very costly liquors. Especially in lively environments, there is little time for this type of attraction or presentation, whatever the price.

Here, both the house and the customer have a problem, especially when a premium beverage is to be used in a complicated mixed drink, and in a busy bar. Examples of such drinks are the Margarita, the Mai Tai, the various fizzes, and Cosmopolitans. In very busy houses, such drinks can not be economically provided when a large number of them must be individually prepared. A single bartender cannot make enough of them at once, nor can he make one or a few of them at the same time when he must also include in the order a few simpler drinks such as bourbon on the rocks, and glasses of wine. Accordingly, servers are discouraged from suggesting orders which include these drinks. A source of very profitable business is often lost, along with a customer's goodwill.

The solution to this problem in large-enough scale operations is to utilize concentrates for the more popular complicated beverages. Here it is not meant to include the common mixing nozzle that combines syrups or elixirs for carbonated or non-carbonated water to make a simple drink. The field of this invention involves the pre-preparation of a substantial number of orders of complex beverages, ready to be dispensed in an icy, slushy condition.

Pre-mixes for this purpose are known, for example to prepare concentrates without liquor. In these, water, and flavoring ingredients are mixed together in a mixing chamber where the resulting icy mixture is continuously recirculated and made available to be dispensed. An example of such a dispenser is shown in Gorski et al U.S. Pat. No. 6,149,035, Issued Nov. 21, 2000. Here there is a continual recirculation of a continuously maintained mixture of ingredients.

Such drinks ultimately can include any kind or class of constituent-cheap vodka, or instead premium-level ingredients such as very expensive vodkas, tequilas or bourbons. A person who wants to obtain a drink and who expects to pay for, and more importantly to receive, a premium ingredient, is left to wonder what he really will receive in a busy house.

So there is the quandary. It is possible for the house to proclaim that its drinks contain only certain types of liquors by name. This can be done by identifying on a sign or menu the well brands used by the house. But what about the customer? He is less impressed by institutional signage than by what he gets in that one drink, and yet he doesn't know.

And what about the house? At a single station, the bartender needs to have at hand a quick source for many copies of a complicated drink, without the fuss of identifying to a purchaser (who may be far down the bar) what actually is being poured from a bottle.

It is the object of this invention to advertise and fulfill the needs of both the house and its customers when a customer orders a complex beverage with a specified (not necessarily costly) component, and to assure the customer that is what he will receive. This also provides the advantage of advertising the availability of the beverage with the specific ingredient.

BRIEF DESCRIPTION OF THE INVENTION

A dispensing system according to this invention includes a source of a first ingredient, for example an identified liquor, a source of a second ingredient, for example a concentrate of other ingredients, and a mixer adapted to receive, chill, and circulate the combination in a slushy or icy state. It further includes a nozzle to draw the drink from the mixer for presentation to the customer.

According to a feature of this invention, the source of the first ingredient (usually the liquor) is placed independently and prominently in plain view. An indicia of activation or supply of this ingredient is provided adjacent to said source indicative of withdrawal of the first ingredient from the source. The nozzle and the indicia are so disposed, arranged, and activated that when the drink is withdrawn the indicia is energized, thereby to inform the customer that the ingredient for his drink comes from that source.

According to a preferred but optional feature of the invention, the system is arranged such that an identical amount of the ingredient is restored to the mixer, to replace the withdrawn liquid, thereby maintaining the system in readiness.

The above and other features of this invention will be fully understood from the following detailed description and the accompanying drawings, in which:

DETAILED DESCRIPTION OF THE INVENTION

Figure 1:
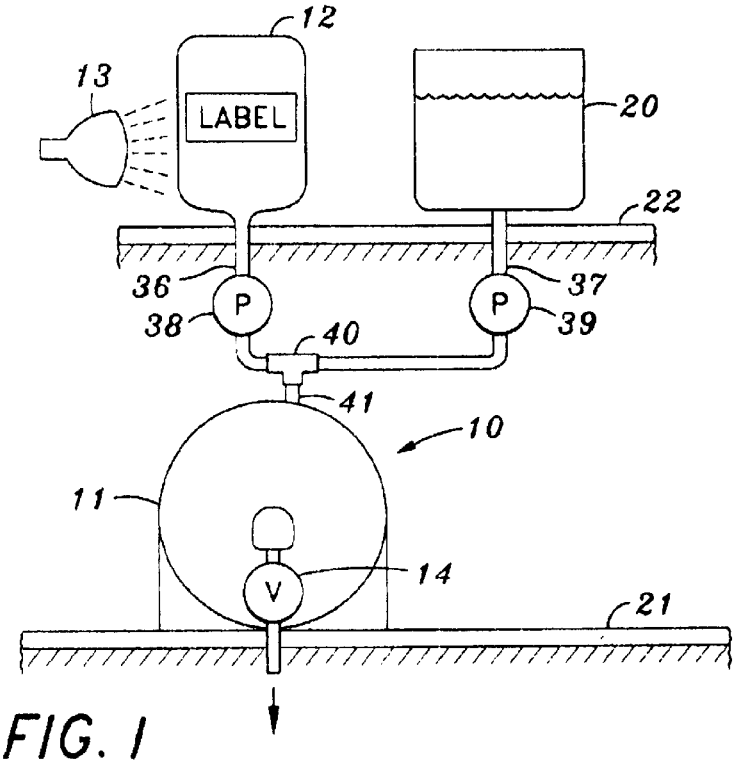
FIG. 1 is an elevation drawing, partly in schematic rotation, showing the presently-preferred embodiment of the invention.

In its most effective presentation, the entire apparatus according to this invention will be in full view. As shown in FIG. 1, a system 10 includes a mixer 11, a source 12 of a first ingredient, an indicator 13, and a valve 14 from the mixer. The mixer contains all of the ingredients of the drink in a slushy state. Opening valve 14 will draw the drink into a container for presentation to the customer.

Source 12 will ordinarily be a bottle of the first ingredient, for example a tequila or a vodka, open with its neck downward in condition for withdrawal and admission of air to permit its exit. Such ingredients, which may or may not be alcoholic, are for convenience called "liquors" herein.

A source 20 of second ingredients is separately plumbed to the mixer. Such second ingredients can include concentrates and water, for example. When the first and second ingredients are combined and properly constituted, the outflow from valve 14 will be the desired drink, usually in a slushy or icy condition.

Source 20 can be located anywhere. It is of no interest to the customer, and in large systems may be many yards away from the mixer.

As best shown in FIG. 1 a shelf 21 supports the mixer, and another shelf 22 supports bottle 12 of the first ingredient. Instead of on a shelf, it can be a wall-mounted unit. The consideration is that the bottle will be in full view, and that there will be a visible response when the liquor is withdrawn from it. This bottle, in full view, will bear a visible label stating the specific ingredient it contains. This will be recognized as the source of the intended product, and what one can expect when the drink is purchased.

Indicator 13 remains dormant except while the specific drink is being dispensed. It is intended to be energized during the time the drink is dispensed. The presently preferred embodiment is a bright lamp, dark when not activated, and shining brightly on the container or label when it is. However, this or a supplementary source of light may be provided to light up the bottle at all times to attract the customer's attention, while providing additional attraction when actuated.

Conduit 36 draws first ingredient from bottle 12. It is withdrawn by a pump 38, preferably a roller pump which dispenses closely controlled volumes per revolution. Conduit 37 draws second ingredient from container 20. It is withdrawn by a similar pump 39. These conduits join at a T joint 40 and combine in a conduit 41 that discharges into mixer 11. Instead, they could separately enter the mixer.

It will be noted that the customer does not drink the specific "slug" of first ingredient that was admitted, because the mixer already contained a larger amount of properly-constituted drink. The indicator does, however, reflect the admission of the proper amount of ingredients to maintain in the mixer a properly constituted reservoir of the drink. The customer will remain satisfied, because the system starts with a legitimate ingredient, and consistently replaces it as it is withdrawn.

More particularly as to the mixer, the disclosure in the Gorski et al patent is incorporated herein in its entirety for its showing of a system to provide a properly-proportioned reservoir of a drink, preferable in an icy situation. As to this invention it includes a reservoir with a chilling and recirculating mechanism (not shown). The mixing chamber receives the first and second ingredients and keeps them in condition for dispensing from valve 14. The details of the chilling and circulating apparatus are of no importance to this invention.

A circuit 45 is shown with a switch 46 as part of the valve 14. When the valve is open, this switch will complete the circuit and turn on the lamp. In addition, switch 46 also actuates pumps 38 and 39 which will admit to the mixer an amount of the liquor and concentrate which will precisely constitute the amount of the ingredients withdrawn.

Switch 46 is linked to valve 14 selectively interconnects leads 47, 48. One of the leads includes a current source 49 such as a battery. Lead 47 connects to one side of pumps 38 and 39, and also to one side of indicator 13, such as lamp. The other electrical sides of these items are connected to lead 48. Closing switch 46 will operate the pumps and actuate the indicator. At the same time, product is flowing from the mixer.

Here it may be commented that instead of mixing concentrate and water in container 20, they could be separately supplied to the T 40. However, in most systems the concentrates and water will be pre-mixed in a larger container. The choice is optional.

Figure 2:
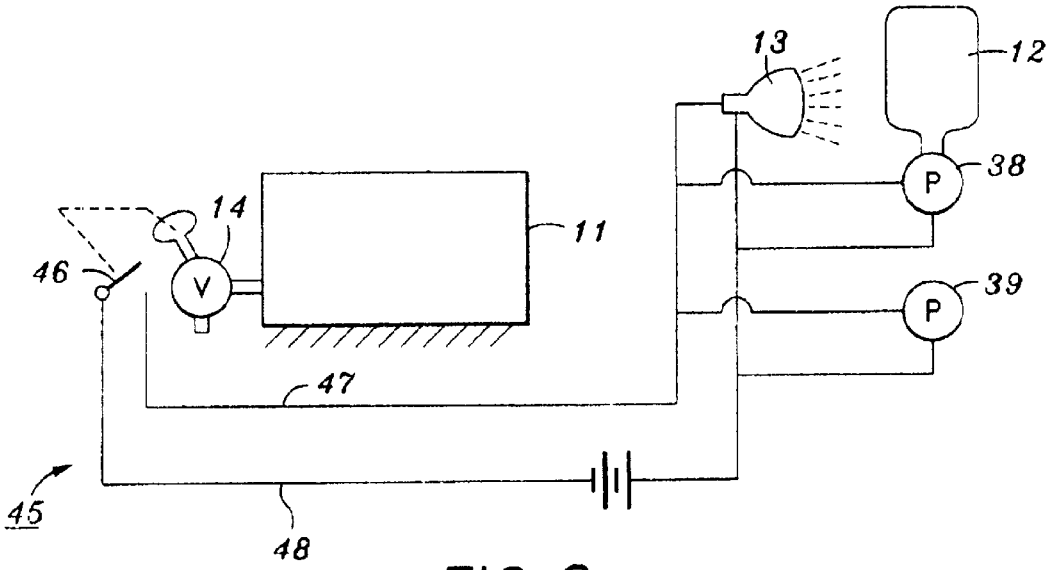
FIG. 2 is a semi-schematic drawing side view showing one embodiment of circuitry to control the system of FIG. 1.
Figure 3:
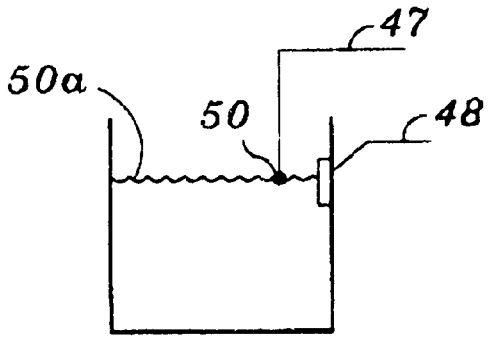
FIG. 3 is a fragmentary circuit view showing a modification of the circuit of FIG. 2.

The circuitry of FIG. 2 does involve providing electrical current (even of very low voltage) to the valve structure. Should this be objectionable, instead of a directly-coupled switch, as shown in FIG. 3, a probe 50 disposed at a liquid rest level 50*a* in the mixer is connected to lead 47. An electrode 51 is mounted in the mixer, and connected to lead 48. When valve 14 is opened, the liquid level 50*a* in the mixer drops below the probe, and the circuit is opened (or closed when relays are used). This will actuate the pumps and indicator until the level in the mixer is restored. When it is restored, the circuit will be completed and the pumps and indicator stopped. It will be recognized that the probe is merely one example of a level-sensor. Floats and other types could be substituted, and circuit modifications can also be made, all within the scope of the invention.

Figure 4:
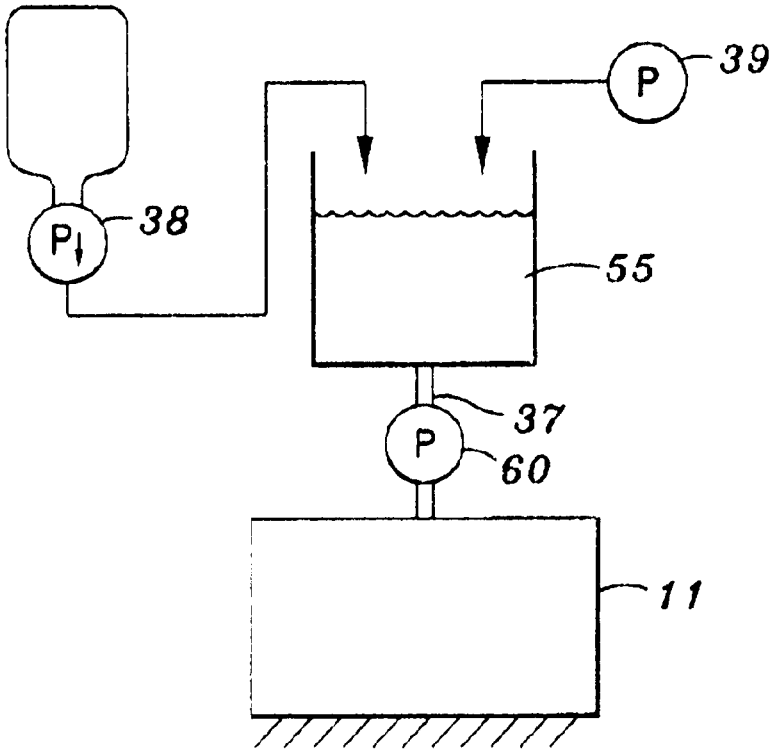
FIG. 4 is a fragmentary view showing a modification of the supply system to the mixer.

FIG. 4 illustrates that the concentrate, water and liquor can be pre-mixed in an intermediate container 55, to which all ingredients can be fed with the outputs of pumps 38 and 39, and withdrawing the completed (but not slushy) drink through a pump 60 (actuated along with the other pumps). This provides a local "reservoir" of drink if for some reason a closer mixed source for the mixer is desired.

While the circuitry of FIG. 3 is decoupled from valve 14, experience with such circuitry has proved that the response is suitably close for all intended purposes. The indication will occur substantially contemporaneously.

The operation of this system is straight forward. The mixer is first primed with a quantity of all ingredients of the intended mixed drink. In operation it serves continually to mix and recycle it. While it is being recycled it is passed through chilling coils (not shown) and thereby kept in a desired slushy or icy condition. When a drink is withdrawn, it is simultaneously replaced in the mixer.

This invention adds to the above ways to advertise the availability of a kind of first ingredient such as a particular brand of vodka or tequila. The evident presence of the bottle provides a guarantee that it is the source. If desired, an outside obvious length of transparent tubing 36 or other plumbing maybe placed between the neck of the inverted bottle and the inlet of the mixer where the flow can be seen. Also, bubbles will rise in the bottle.

Lamp 13 may be a still or moving lamp, or a strobe lamp as preferred. This assures the customer that he is obtaining a drink which comprises this particular ingredient. This invention thereby makes available to a busy house such as a casino or club, a source of ready-to-serve complicated drinks, and to the customer it advertises the availability of intended ingredients and reassurance that he is receiving them.

This invention is not to be limited by the embodiments shown in the drawings and described in the description, which are given by way of example and not of limitation, but only in accordance with the scope of the appended claims.

What is claimed:

1. In a beverage supply system of the type which includes a mixer having a mixing chamber for holding a drink mixture comprising at least a first and a second ingredient, said first ingredient being prominent and of interest and importance to customers for such beverages, said mixer receiving from a first source a supply of said first ingredient, and from a second source a supply of said second ingredient, and a release valve on said mixing chamber for releasing a beverage to be consumed by a customer, the improvement comprising:

said first source exposed to the view of a prospective customer;

an indicator associated with said first source adapted and so disposed and arranged as to provide a visible signal that first ingredient is being withdrawn from said first source while this event is occurring;

a control circuit responsive to withdrawal of beverage from the mixer whereby, substantially contemporaneously while beverage is withdrawn, the circuit will energize the indicator.

2. Apparatus according to claim 1 in which said first source is a bottle of the first ingredient.

3. Apparatus according to claim 2 in which said bottle is placed on an elevated shelf.

4. Apparatus according to claim 1 in which said mixer is a recirculating refrigerating type to provide a slushy or icy drink.

5. Apparatus according to claim 1 in which said control circuit includes a switch directly coupled to the release valve.

6. Apparatus according to claim 1 in which said control circuit includes a probe sensitive to the level of beverage in said mixer, and energizes the indicator while said liquid level is below a rest level.

7. Apparatus according to claim 1 in which a first pump draws first ingredient and a second pump draws second ingredient, said pumps being under control of said control circuit.

8. Apparatus according to claim 7 in which said pumps are roller pumps delivering proportioned volumes of respective ingredients.

9. Apparatus according to claim 7 in which the outputs of said pumps are combined before supplying them to said mixer.

10. Apparatus according to claim 7 in which the outputs of said pumps are separately supplied to said mixer.

11. Apparatus according to claim 7 in which the outputs of said pumps are supplied to a container from which their mixture is provided to the mixer.

12. Apparatus according to claim 7 in which said control circuit includes a switch directly coupled to the release valve.

13. Apparatus according to claim 7 in which said control circuit includes a probe sensitive to the level of beverage in said mixer, and energizes the indicator while said liquid level is below a rest level.

14. Apparatus according to claim 1 in which the indicator is a lamp.

15. Apparatus according to claim 6 in which said lamp is a still, moving, or strobe type.

* * * * *